US005518485A

United States Patent [19]

Zislis

[11] Patent Number: 5,518,485

[45] Date of Patent: May 21, 1996

[54] METHOD AND APPARATUS FOR STABILIZING THE UPPER BODY WHILE STRETCHING THE SOFT TISSUE AROUND THE SHOULDER GIRDLE AND BACK

[75] Inventor: Michael W. Zislis, Denver, Colo.

[73] Assignee: Precision Therapeutics, P.C., Denver, Colo.

[21] Appl. No.: 327,356

[22] Filed: Oct. 19, 1994

[51] Int. Cl.[6] ..... A63B 23/12

[52] U.S. Cl. ..... 482/131; 482/139; 482/907; 601/23

[58] Field of Search ..... 482/44, 131, 907, 482/91, 114, 123, 133, 134, 139, 104, 148, 904; 601/33, 23; 128/782, 878, 845; 602/36, 33; 606/241; 5/623, 646, 647

[56] References Cited

U.S. PATENT DOCUMENTS

| | | | |
|---|---|---|---|
| 1,964,930 | 7/1934 | Siebrandt | 602/33 |
| 3,353,532 | 11/1967 | Ellis | 606/241 |
| 3,942,790 | 3/1976 | Rice | 482/151 |
| 4,836,523 | 6/1989 | Englander | 5/647 |
| 5,048,827 | 9/1991 | Caruso | 482/904 |
| 5,353,809 | 10/1994 | Faucher | 128/845 |

FOREIGN PATENT DOCUMENTS

| | | | |
|---|---|---|---|
| 4022836 | 1/1992 | Germany | 128/845 |

*Primary Examiner*—Joe Cheng
*Assistant Examiner*—Jeanne M. Clark
*Attorney, Agent, or Firm*—Davis, Graham & Stubbs

[57] ABSTRACT

A method and apparatus for stretching and exercising the soft tissue surrounding the shoulder girdle and back, while stabilizing the upper extremities. In a preferred embodiment, a pair of elbow/forearm cuffs are mounted on a lower horizontal bar, and a second horizontal bar is attached above the lower horizontal bar. The users elbows/forearms are placed in the cuffs on the lower bar, while their hands slide back and forth along the upper bar.

6 Claims, 2 Drawing Sheets

METHOD AND APPARATUS FOR STABILIZING THE UPPER BODY WHILE STRETCHING THE SOFT TISSUE AROUND THE SHOULDER GIRDLE AND BACK

FIELD OF THE INVENTION

The present invention relates to the field of physical therapy rehabilitation and sports medicine, and potentially to the area of physical fitness exercisers.

BACKGROUND OF THE INVENTION

Devices have been developed for stretching and exercising the soft tissue surrounding the shoulder girdle and the back. A typical apparatus designed for stretching and exercising the tissues surrounding the shoulder and back is a device where a hand grip is grasped by the user and moved back and forth on an elongated rod against a resistive force. One variation to said device allows the rod to be pivotally connected to a support, allowing a variety of exercises. However, a problem encountered by using this type of apparatus to stretch the tissue surrounding the shoulder girdle and back is that the user's body is not properly stabilized. When the body is not properly stabilized, the user may substitute motions for those desired and the result may ultimately be harmful to the user.

For example, U.S. Pat. No. 3,971,255 of Varney et al. discloses an exercise apparatus which is comprised of a housing and a shaft extending therethrough for frictionally resisted axial movement of the shaft relative to the housing. The housing includes adjustable braking means to allow the user to vary the level of resistance to such axial movement, and operatively associated with the shaft are readout means to indicate to the user in units of applied force the instantaneous level of resistance effective as the shaft is moved axially relative to the housing.

U.S. Pat. No. 2,621,043 of Olmstead discloses an exercise apparatus comprised of a moveable hand grip is slidable along an elongated rod, and can be manipulated in such a manner that during the back and forth movement of the hand grip, the resistive force to such movement is always under the control of the user and can be changed instantaneously. The device can be pivotally connected to a support to enable the user to perform a variety of exercises for conditioning the body.

Although the devices described in the patents named above allow for the stretching of the tissue surrounding the shoulder girdle and the back, one drawback is that they do not provided stabilization of the body to eliminate substitute motions. Without the proper stabilization of the upper extremities, the user may, through substitute motions, exercise or stretch in a manner which is counter-productive to their goals.

A shoulder flexibility device is needed that will properly stabilize the upper extremities and prevent substitute motions by the user. Such device should provide static counter force vectors which oppose the natural tendency for the user's elbows to abduct and shoulders to extend and internally rotate when there is tightness of specific muscles and connective tissue in the shoulder girdle and latissimus dorsi muscle. The device should stabilize the elbow and forearm in such a way as to allow the user to move into progressively greater degrees of shoulder flexion, adduction and external rotation. When used by a patient in physical therapy, the device should help restore the normal muscle and connective tissue length in the shoulders and back. The restoration of optimal scapulohumoral and scapulothoracic length-tension relationships will result in more ideal scapular motion during functional activity. This will in turn reduce the potential for shoulder girdle impingement, and therefore reduce the tendency for myofascial pain syndromes as well as bursitis, capsulitis and tendonitis.

An added benefit to an apparatus which enforces a stabilized position of the upper extremities is that it allows the user to concentrate on scapular motions which are necessary for full pain-free shoulder elevation with a reduced potential for impingement.

Another benefit of an apparatus which enforces a stabilized position of the upper extremities is that by moving the scapulae caudally with the upper extremities stabilized, a significant stretch occurs of the inferior joint capsule and muscles that extend the humerus relative to the scapula.

SUMMARY OF THE INVENTION

This invention provides a solution to the problem of stabilizing the body while stretching the soft tissue surrounding the shoulder girdle and back. More specifically, the present invention is a shoulder stabilization device which stabilizes the elbow and forearm in such a way as to allow the user to move into progressively greater degrees of shoulder external rotation, flexion and adduction as well as lengthening the latissimus dorsi muscle, while eliminating substitute motion which can be counter productive, even harmful to the patient.

The elbow/forearm stabilization device of this invention provides static counter force vectors which oppose the natural tendency for the user's elbows to abduct and shoulders to internally rotate when there is tightness of specific muscles and connective tissue in the shoulder girdle and the latissimus dorsi muscle.

The soft tissues which are stretched by the device of this invention include: Latissimus Dorsi, Long Head of Triceps, Teres Major, Serratus Anterior, Subscapularis, Teres Minor, Infraspinatus, Axillary Fascia, and Inferior and Posterior Joint Capsule.

In addition to the passive stretching just described, the user may also be instructed to activate the lower and middle trapezius and serratus anterior muscles to assist the scapula in upward rotation about the sagittal plane and tilting about the frontal plane. The stabilized position of the upper extremities is ideal for allowing the user to concentrate on these scapular motions which are necessary for full pain-free shoulder elevation with a reduced potential for impingement.

Also, by moving the scapulae caudally with the upper extremities stabilized, a significant stretch occurs of the inferior and posterior joint capsule and muscles that extend the humerus relative to the scapula such as the Teres Major, Latissimus Dorsi and Posterior Deltoids. These soft tissues are often shortened and may contribute to abnormal scapulohumoral biomechanics which can result in myofascial pain syndromes, bursitis, capsulitis and tendonitis.

In a preferred embodiment of the invention, a pair of forearm stabilization cuffs are attached to a floor-mounted horizontal bar. Optionally, the pair of forearm stabilization cuffs may be attached to a wall mounted horizontal bar. The forearm cuffs may be fabricated from plastic, aluminum, or any other relatively rigid material that will securely support the elbow and forearm.

A second horizontal hand bar is attached to a pair of vertical supporting braces at a pre-set distance above the horizontal bar to which the forearm stabilization cuffs are attached. The overall distance between the lower and upper horizontal bars is adjustable to accommodate patients of different sizes.

The floor-mounted horizontal bar, the upper horizontal bar and vertical supporting braces may be formed of any suitable material, such as metal or molded plastic.

The user presets the position of the forearm stabilization cuffs so that the elbows are placed lateral to the hands when grasping the horizontal hand bar. The user lies prone and places his or her forearm in the stabilization cuff.

The user grasps the horizontal hand bar and establishes 90 degrees of elbow flexion. In a preferred embodiment of the invention, the user slides their hands back and forth along the horizontal hand bar. In another embodiment, the motion of the user's hands may be achieved by attaching hand grips formed of any suitable material such as rubber or plastic to the upper horizontal bar which are axially movable along the bar.

Gradually as the user's shoulder and back muscles relax and lengthen, the forearm stabilization cuffs are moved inward and the user places his or her handgrip in a progressively more lateral position relative to the elbows.

DESCRIPTION OF THE INVENTION

Figure 1:
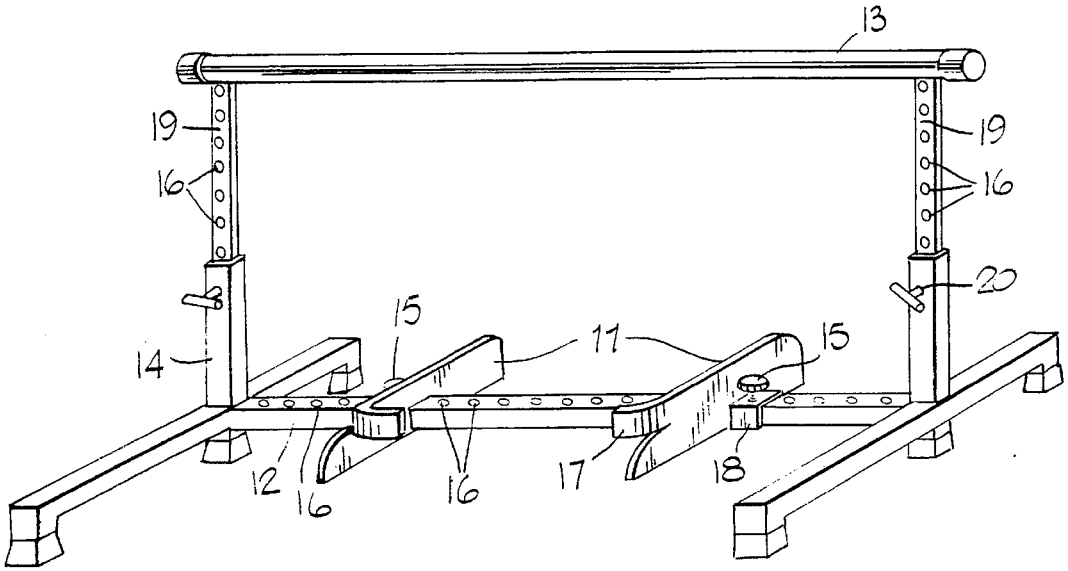
FIG. 1 is a perspective view of the preferred embodiment of the invention

In a preferred embodiment the shoulder stabilization device is comprised of the following components seen with reference to FIG. 1:

(a) a pair of forearm stabilization cuffs 11

(b) a lower horizontal bar in a frame having a set of floor mounts 12

(c) an upper horizontal bar 13

(d) a pair of vertical end braces 14

(e) two pairs of threaded screws 15

(f) a plurality of threaded notches 16

The forearm stabilization cuffs 11 are best described with reference to FIGS. 4–7. As can be seen with reference to FIG. 4, the forearm cuffs 11 have a suitable surface to receive the user's forearm such that the hook shaped ends 17 curve around the right and left forearms. The forearm cuffs 11 may be fabricated from plastic or any other relatively rigid material that will securely support the elbows and forearm. The forearm cuffs 11 may be molded in a variety of sizes that will include at a minimum a small cuff for a small or young patient and a larger size cuff to support a full grown patient.

The forearm stabilization cuffs 11 are also detachable. By removing the threaded screw 15 from the threaded notch 16 (seen with reference to FIG. 1) on the lower horizontal bar 12, the cuff 11 may easily be removed. This feature allows the cuff 11 to be interchanged with a different size cuff 11, or merely to be cleaned.

Figure 5:
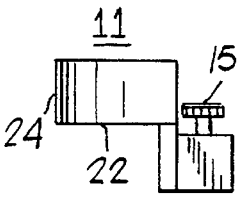
FIG. 5 is a front view of a stabilization cuff
Figure 7:
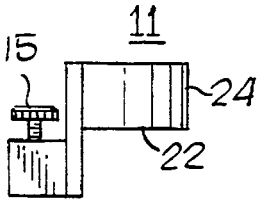
FIG. 7 is a rear view of a stabilization cuff

With reference to FIGS. 5 and 7, it can be seen that the forearm stabilization cuffs 11 are not very wide, but rather fitted for a firm engagement with the patient's elbow/forearm. The width 22 of the cuff comes in a variety of sizes to support various sized patients. The height 24 of the cuff 11 is designed to rise between 2" and 3" above the patient's elbow. This is to allow for firm support of the elbow while permitting the maximum range for the patient's hand motion as they perform the exercise.

Figure 6:
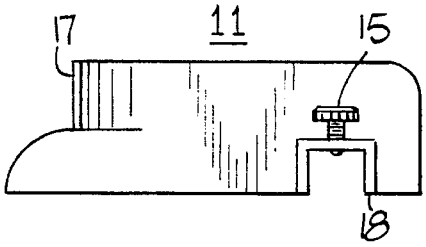
FIG. 6 is side view of a stabilization cuff

Continuing the discussion with reference to FIG. 6, it can be seen that the forearm stabilization device is mounted on the lower horizontal bar 12 (as seen in FIG. 1) by a three-sided rectangular shaped frame 18 which is located on the bottom side of the cuff 11 at the proximal end. The rectangular frame 18 is shaped in a manner that is compatible with the shape of the lower horizontal bar 12, so that the frame 18 is placed over the lower horizontal bar 12 in a way the creates a secure engagement. The cuffs 11 are mounted on the lower horizontal bar 12 with the hooked distal ends 17 of the cuff 11 curving inward toward each other. Each cuff 11 is then secured on the lower horizontal bar 12 by engaging the threaded screw 15 into one of the threaded notches 16 (seen in FIG. 1). The notches 16 are positioned along the top side of the lower horizontal bar to allow for adjusting the distance between the stabilization cuffs 11, supporting patients of various sizes. In an alternative embodiment, the cuff 11 may be secured on the lower horizontal bar 12 by using a pin and hole arrangement, not shown.

Resuming the conversation now with reference to FIG. 1, it can be seen that the upper horizontal bar 13 is positioned above the stabilization cuffs 11 by sliding the upper portion of the vertical supports 19 into the shafts located in the lower portions of the vertical supports 14. When a desired distance is reached between the upper 13 and lower 12 horizontal bars, the apparatus is secured by engaging the threaded screws 15 through the threaded notch 20 located in the top of the lower portion of the vertical support 14, and through a threaded notch 16 located along the upper vertical support 19.

Once the stabilization cuffs 11 and the horizontal hand bar 13 are set to the position that will support the size of the patient, the device is ready to be used. The therapy method for the upper extremities of this invention is best described with reference to FIGS. 2 and 3.

Figure 2:
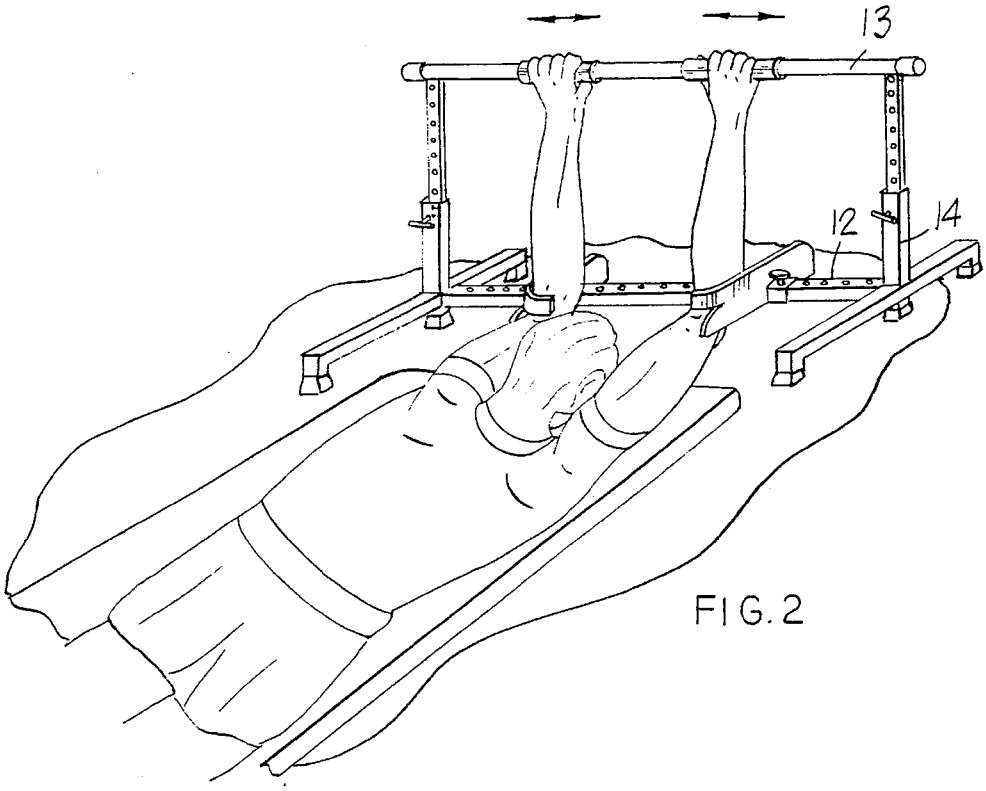
FIG. 2 is a perspective view of the invention with the patient's forearms engaged in the stabilization cuffs

As seen in FIG. 2, the patient lies prone, face down, perpendicular to the apparatus. Optionally, using a wall mounted version which was described earlier but not depicted in the drawings, the patient may stand facing the wall under the device, where the device extends out from the wall at a 90 degree angle. The patient places his or her forearms into the stabilization cuffs 11 and grasps the horizontal hand bar to establish 90 degrees of elbow flexion.

Figure 3:
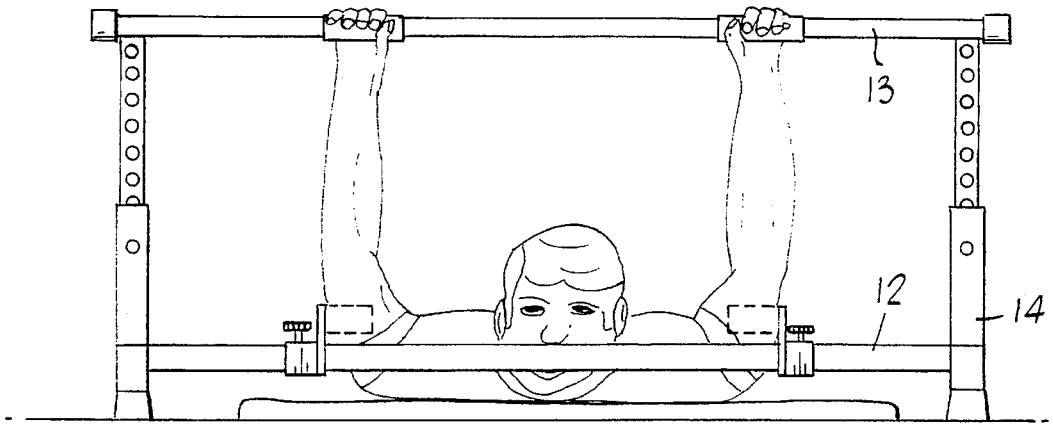
FIG. 3 is a frontal view of the invention with the patient's forearms engaged in the stabilization cuffs
Figure 4:
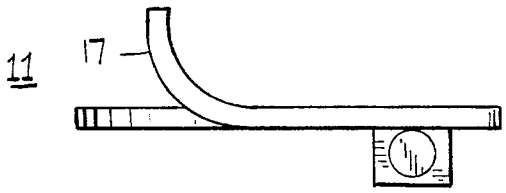
FIG. 4 is a top view of a stabilization cuff

Next, the patient slides his or her hands along the horizontal hand bar. The patient's hands start close to each other, medial to their elbows, and gradually move apart from each other so that they are even with the elbows or slightly lateral to the elbows. The motion of the patient sliding his or her hands along the horizontal bar is depicted by FIG. 3.

An optional feature of the apparatus of this invention which is not shown in the drawings but readily understood is a face pad attached to the lower horizontal bar 12. The face pad may be constructed from any suitable soft and supportive material such as foam. The face pad attachment means may include snaps at the end of soft cloth strips which are designed to encircle the lower horizontal bar 12. Alternatively, velcro may be used to secure the pad to the lower horizontal bar 12. The face pad is designed to provide support and comfort for the patients nose/face while using the device since the patient is positioned relatively close to the floor in a floor mounted device or the wall in a wall mounted device.

What is claimed is:

1. A floor-mounted apparatus for stabilizing the upper extremities of a patient comprising:

(a) a frame having a set of floor mounts for resting the apparatus on the floor, (b) a cuff mount attached to the floor mounts, (c) a pair of spaced apart elbow/forearm cuffs for receiving a pair of elbows/forearms from the patient adjustably mounted on the cuff mount, wherein each elbow/forearm cuff includes a body portion extending generally perpendicular to the cuff mount and an end portion curving from the body portion toward the other elbow/forearm cuff to define a curved surface to receive an elbow and forearm respectively, and (d) a horizontal bar attached to the frame, the horizontal bar positioned above the cuffs for grasping by the patient.

2. The apparatus of claim 1 wherein the floor mounts include a first set of mounts and a second set of mounts, the first set of mounts and second set of mounts being connected by the cuff mount, and each set of mounts being attached to a telescopic upright attached to the horizontal bar.

3. The apparatus of claim 2, wherein the cuffs are adjustably mounted to the cuff mount by slideably positioning the cuffs on the cuff mount to vary the spacing therebetween; and the horizontal bar positioning above the cuffs is adjustable by lengthening or shortening the uprights.

4. A method of therapy for the upper extremities of a patient comprising:

(a) providing a device comprising a frame having a set of floor mounts for resting the apparatus on the floor; a cuff mount attached to the floor mounts; a pair of spaced apart elbow/forearm cuffs for receiving a pair of elbows/forearms from the patient, adjustably mounted on the cuff mount wherein each elbow/forearm cuff includes a body portion extending generally perpendicular to the cuff mount and an end portion curving from the body portion toward the other elbow/forearm cuff to define a curved surface to receive an elbow and forearm respectively, and a horizontal bar slidably attached to said frame, said horizontal bar positioned above the cuffs for grasping by the patient;

(b) placing the patient in a prone position on any surface wherein a left elbow of the patient engages the left elbow cuff and a right elbow of the patient engages the right elbow cuff, the right and left elbow cuffs being adjustably spaced apart on the cuff mount attached to the frame, and (c) moving the patients hands together and apart along the horizontal bar to effect such upper extremity therapy.

5. The therapy method of claim 4, wherein the spacing of the left and right cuffs on the cuff mount is adjustable, and further comprising adjusting said spacing to gradually increase the upper extremity flexibility.

6. The therapy method of claim 5, wherein the horizontal bar is attached to the frame by a pair of telescopic uprights and further comprising adjusting the position of the horizontal bar above the cuffs to accommodate a length of patient forearm.

* * * * *